US006059626A

United States Patent [19]

Kimura et al.

[11] Patent Number: 6,059,626

[45] Date of Patent: May 9, 2000

[54] SCREEN MANUFACTURING METHOD USING FLAT DISPLAY PANEL

[75] Inventors: Kazuo Kimura; Kazuhisa Hemmi; Kazumasa Ogura, all of Tokyo, Japan

[73] Assignee: Mitsubishi Denki Kabushiki Kaisha, Tokyo, Japan

[21] Appl. No.: 09/263,627

[22] Filed: Mar. 5, 1999

[30] Foreign Application Priority Data

Sep. 30, 1998 [JP] Japan ..... 10-277156

[51] Int. Cl.[7] ..... H01J 9/24

[52] U.S. Cl. ..... 445/24

[58] Field of Search ..... 445/24

[56] References Cited

U.S. PATENT DOCUMENTS 3,461,522 8/1969 Vodicka ..... 445/24

FOREIGN PATENT DOCUMENTS 9844531 10/1998 WIPO .

*Primary Examiner*—Kenneth J. Ramsey
*Attorney, Agent, or Firm*—Rothwell, Figg, Ernst & Kurz

[57] ABSTRACT

A screen manufacturing method makes it possible to manufacture a display screen using flat display panels and to consistently form a flat display screen. More specifically, m flat display panels are fixed on a holder during a manufacturing process of the display screen, and then a flexible substrate is fixed to electrode pins of a flat display panel which project over a back surface of the holder so as to form a unit. After fitting a frame to the unit, a part on which a connector is arranged with a part of the flexible substrate being bent is fitted on a surface of the frame so as to form a submodule. Then, by connecting submodules, a module is formed. By assembling the module, a display screen is produced.

8 Claims, 9 Drawing Sheets

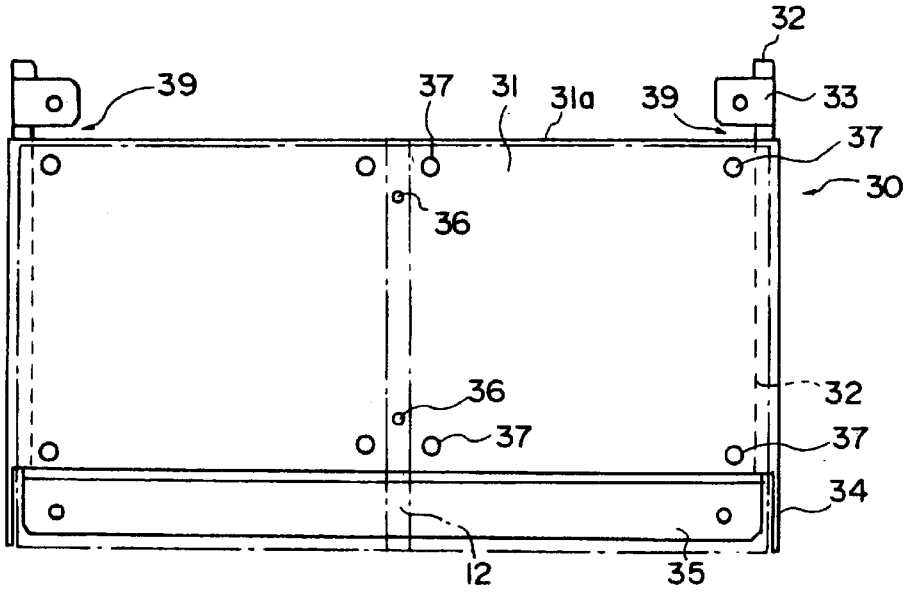
FIG. 7(a)
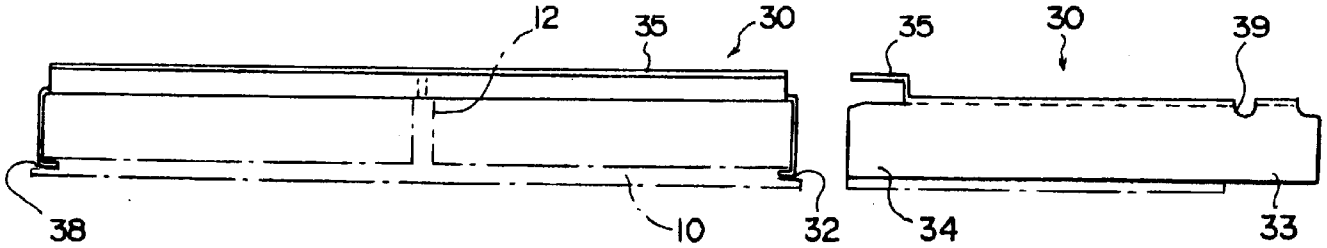
FIG. 7(b)
FIG. 7(c)

SCREEN MANUFACTURING METHOD USING FLAT DISPLAY PANEL

BACKGROUND OF THE INVENTION

1. Field of the Invention

The present invention relates to a screen manufacturing method, particularly a method of manufacturing a large screen using a plurality of flat display panels.

2. Description of the Related Art

Methods of using plasma displays as parts for manufacturing a large display screen is around 250 centimeters to several meters are known. Such plasma displays are characterized in that a single display board of a relatively large size can be formed. Iages are displayed by applying voltage from both sides of the display board. However, as the display board becomes larger, image quality at the center of the screen deteriorates due to the internal resistance of the display board's electrode line.

Thus, if a display screen is formed by longitudinally and latitudinally arranging a plurality of small size flat display panels which can be driven independently, it will be possible to easily manufacture a large screen of more than dozens of meters without the above difficulties.

However, heretofore, display screens have been manufactured by individually installing the flat display panels. It is therefore difficult to properly arrange the flat display panels on the same plane so that they form a single display screen.

Further, in order to drive each of the flat display panels, each electrode pin fitted to the back surface of a flat display panel must be connected with external equipment for driving the flat display panels. However, compared with a plasma display, a relatively large number of wires, and therefore a great deal of labor, is required.

SUMMARY OF THE INVENTION

The present invention is made in order to solve the problems described above. The object of the present invention is to provide a screen manufacturing method which facilitates manufacture of a display screen using flat display panels and forms a flat display screen by using flat display panels.

In order to achieve the object described above, the screen manufacturing method using flat display panels according to the present invention comprises a panel fixing step of aligning flat display panels each of which can independently be driven and perform display using a display section provided on its surface in response to application of voltage to electrode pins installed on its back surface and fixing the flat display panels on a surface of a panel fixture and a substrate fitting step of fitting a flexible substrate for electrically connecting external equipment which drives the flat display panels to electrode pins of the flat display panels which penetrate through an opening provided at the panel fixture and project over a back surface side of the panel fixture, wherein the flat display panels, the panel fixture, and the flexible substrate are unified during a process of producing a screen by aligning the plurality of flat display panels, so that a unit is formed.

Further, the panel fixing step may include a positioning step of determining on which position of the panel fixture the plurality of flat display panels are stuck for arranging the flat display panels and a fixing step of fixing the flat display panels to a position on a flat surface of the panel fixture which was predetermined at the positioning step.

Further, the positioning step may be carried out at the time of fixing the flat display panels on the panel fixture using a sticking jig. The sticking jig has a guide hole in which the electrode pin of the flat display panel is to be inserted and is removably installed at the opening of the panel fixture.

Further, the screen manufacturing method may include a frame fitting step of fitting to the unit a frame having a plate type body which surrounds the back surface side of the panel fixture and a connector forming step of fixing, by bending the flexible substrate, on a surface of the plate type body of the frame a joint, which protrudes from between the panel fixture and the frame, with the external equipment electrically connected by the flexible substrate, and a submodule is formed by fitting the frame to the unit.

Further, the frame fitting step may include a step of fitting a bent section which is formed by bending both ends of the plate type body of the frame into junction grooves provided at both ends of the panel fixture.

Further, the screen manufacturing method may also include a connecting step of connecting a connection member fitted to the frame with another submodule, and by connecting the submodules described above in a direction that the submodules are at right angles to a row of the flat display panels installed on the panel fixture, a module is formed.

Further, the connecting step may include a step of fixing a bent section formed by bending both ends of the plate type body of the frame into the junction grooves provided at both ends of the panel fixture which constitutes another submodule connected with the connection member.

Further, by connecting the connection member of the frame which constitutes the module with another module, a display screen comprising the plurality of flat display panels arranged longitudinally and latitudinally may be formed.

According to the present invention, a unit is formed by fixing a plurality of flat display panels, or a submodule is formed by fitting a frame to the unit, or further a module is formed by connecting a plurality of submodules. Thus, due to unitization, submodularization, and modularization achieved in advance using a plurality of flat display panels, it is possible to facilitate positioning of each flat display panel on a display screen. Therefore, it is possible to facilitate assembly of a relatively large display screen formed by flat display panels.

Further, since each flat display panel is fixed to a panel fixture after positioning, a plurality of flat display panels can be aligned on the panel fixture. Thus, it is possible to neatly align each flat display panel in a row without causing unevenness of the row, whereby a single display screen formed by a plurality of flat display panels can be made flat.

Further, electrodes of flat display panels can be extended and gathered at a single joint to be connected with external equipment. Therefore, the rear of the flat display panels does not become cluttered, and wiring can be easily performed.

BRIEF DESCRIPTION OF THE DRAWINGS

FIG. 7 shows the constitution of a frame used according to the present invention.

DESCRIPTION OF THE PREFERRED EMBODIMENT

A preferred embodiment of the present invention will be described below with reference to the accompanying drawings.

Figure 1:
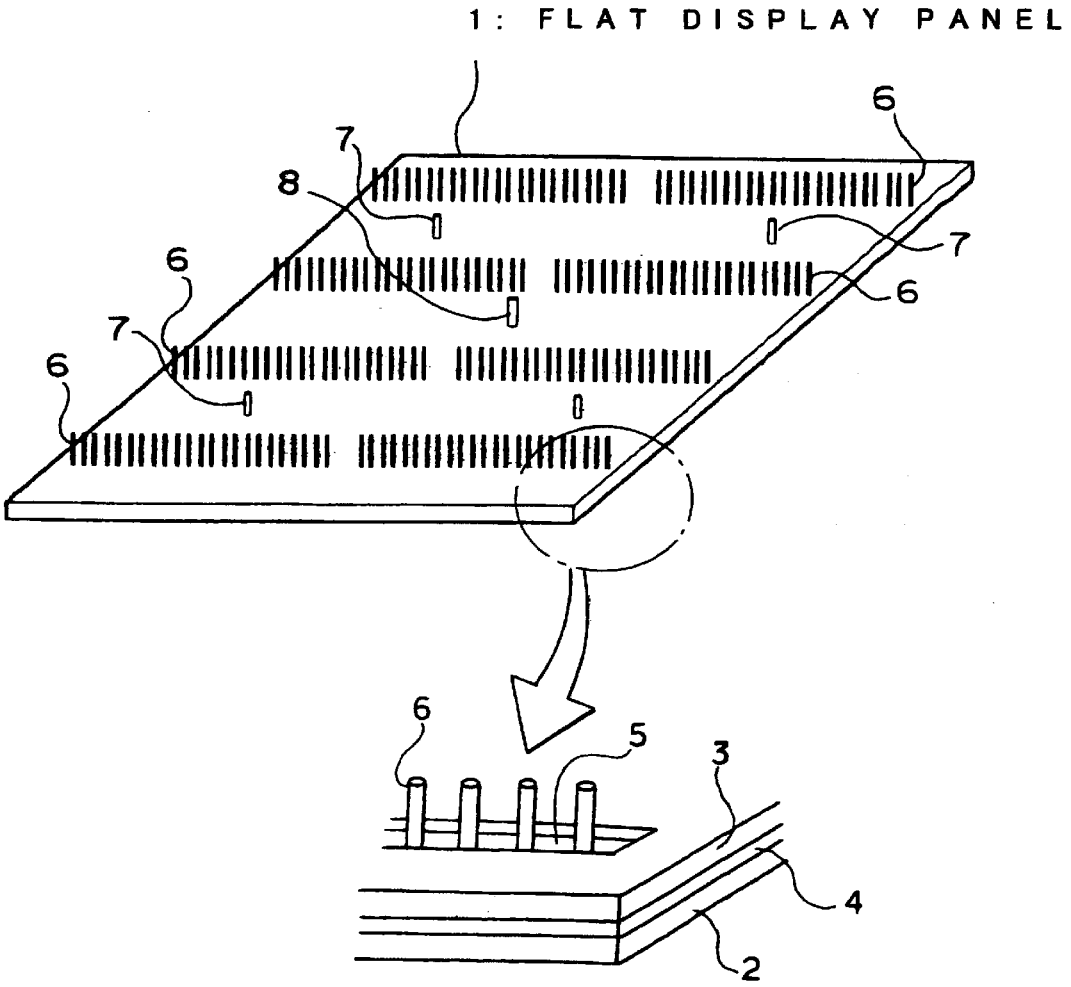
FIG. 1 is a block diagram showing flat display panels used for producing a display screen according to an embodiment of the present invention.

FIG. 1 is a block diagram showing an embodiment of flat display panels used for manufacturing a display screen by a screen manufacturing method according to the present invention. The flat display panels 1 used in this embodiment are manufactured, for example, by a method which is disclosed in an international application (application number: PCT/JP98/01444) filed by the applicant of the present invention according to the Patent Cooperation Treaty. In the flat display panels 1, a transparent front glass substrate 2 on which a pair of electrodes are provided and a back glass substrate 3 on which a discharging space of a display cell is formed by providing a concave are at a position opposite to the electrodes are layered, and a sealed layer 4 is formed by applying a frit glass to seal between the substrates. On a back surface of the flat display panel 1, lead pins 6 and 7 are installed in a standing position on individual electrodes and on common electrodes via an electrode takeoff window 5 of the back glass substrate 3. With such a constitution, it is possible to produce flat display panels 1 which can be individually driven at each display cell. An exhaust glass tube 8 required at the time of producing the flat display panels 1 is installed at nearly the center of the back surface of the flat display panels 1.

This embodiment in which a display screen is produced by longitudinally and latitudinally (m×n units; m and n are natural numbers) arranging flat display panels 1 having the constitution described above, is characterized in that a unit is formed by fixing m flat display panels 1 and corresponding flexible substrates on a holder during a process of producing the display screen, a submodule is formed by fitting a frame to the unit and further fitting a connector for electrically connecting external equipment, for driving the flat display panels 1 with the flat display panels 1, and a module is formed by connecting submodules. As described above, by modularization using a plurality of flat display panels 1, it is possible to facilitate assembly of a relatively large display screen. Further, a display screen formed by the flat display panels can be a flat more reliably.

Figure 2:
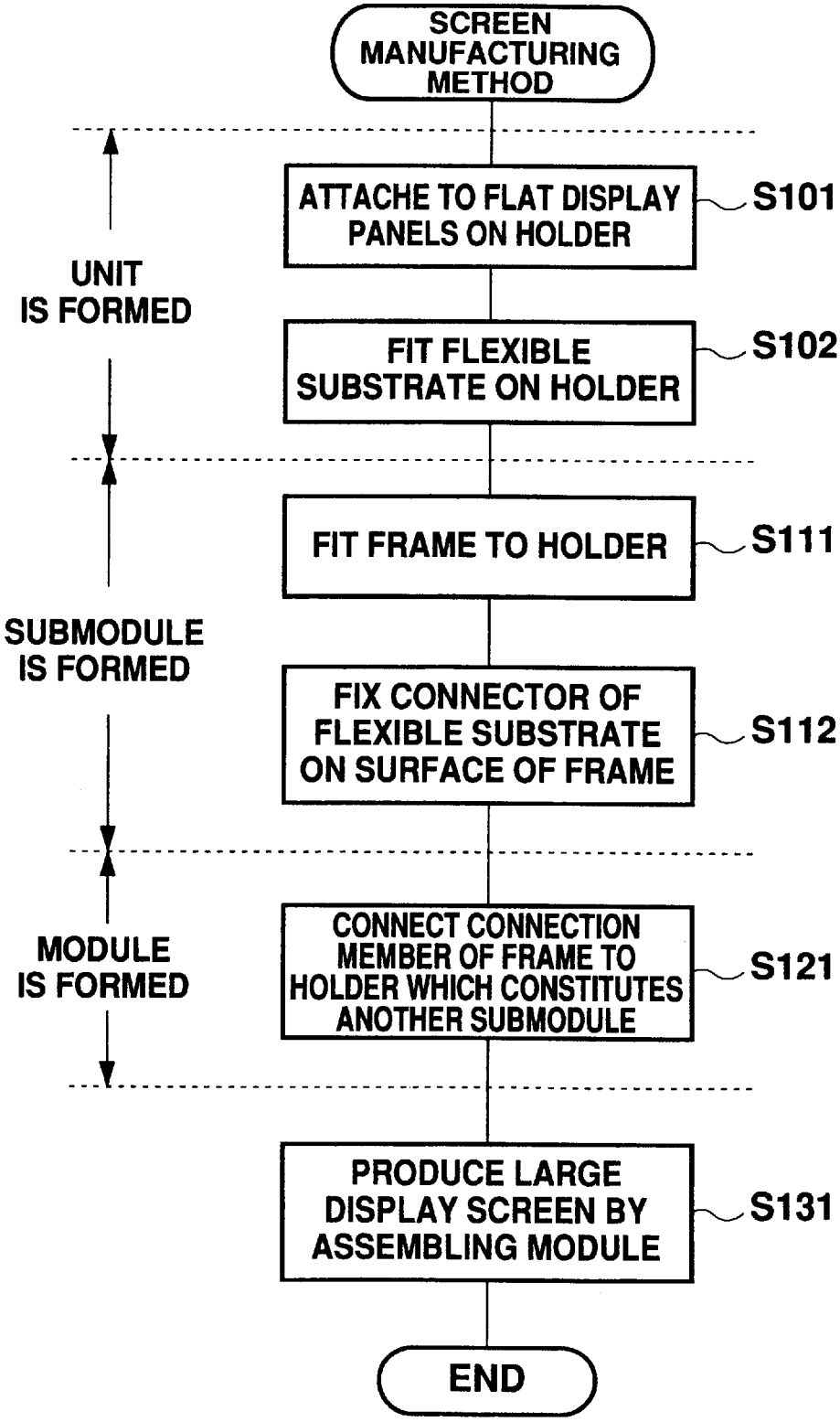
FIG. 2 is a flowchart showing a manufacturing method of a display screen according to the present invention.

The manufacturing method of a display screen according to the embodiment will subsequently be described with reference to the flow chart shown in FIG. 2.

First, a unit is formed by fitting m flat display panels 1 and corresponding flexible substrates on a holder one at a time in such a manner that they are aligned in the same direction. In this example, the direction of aligning the flat display panels 1 on the holder 10 is the transverse direction of the screen and the direction of connecting submodules is the longitudinal direction. For further simplification of the description, m is 2 in this example.

Figure 3A:
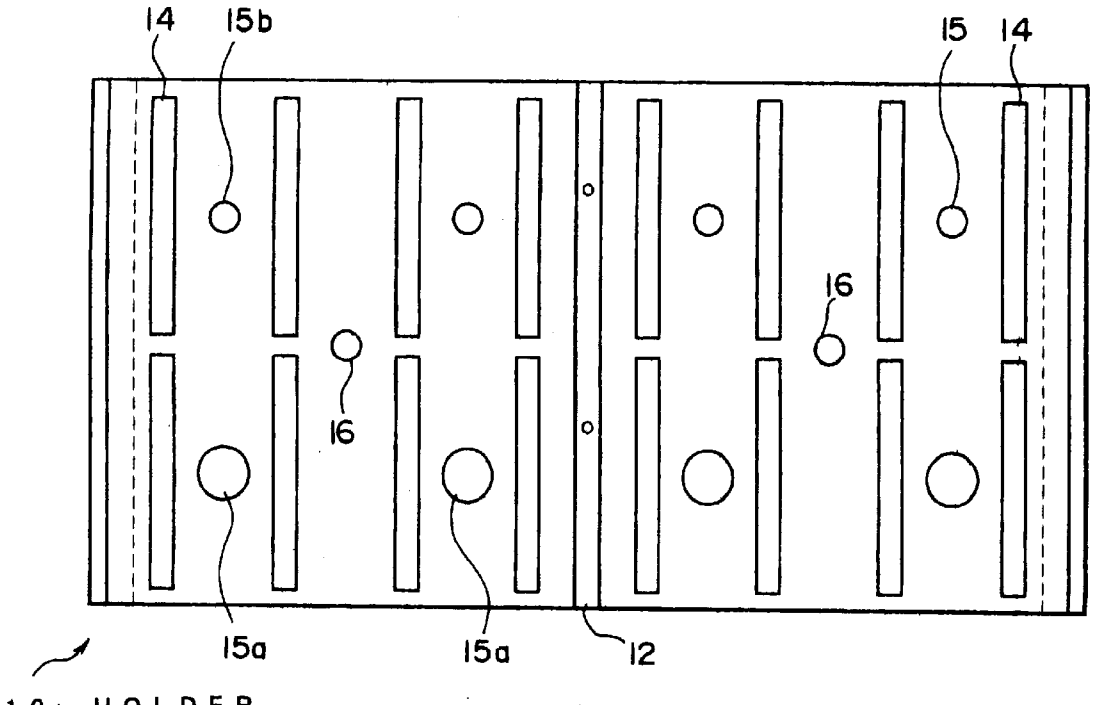
FIGS. 3[*a*+*b*] shows constitution of a holder according to the present invention.
Figure 3B:
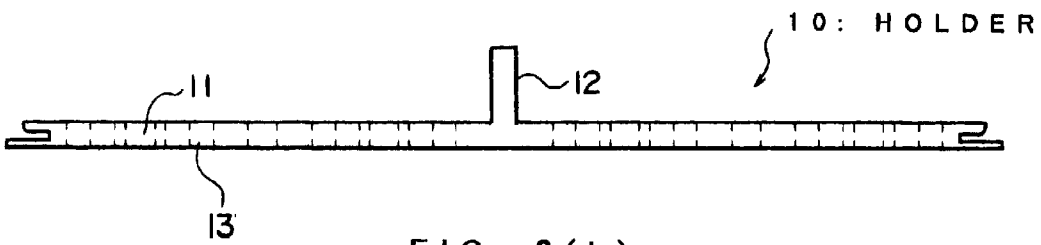

Two flat display panels 1 are fixed on the holder one at a time (Step 101). FIG. 3(*a*) is a plan view of a back surface of the holder 10 provided as a panel fixture according to the embodiment. This view is from the opposite side of a fitting surface of the flat display panels 1. FIG. 3(*b*) is a side view of the holder 10. The holder 10 is composed of a plate type substrate 11 on which the flat display panels 1 are fixed and a plate 12 which is installed at near the center of the substrate 11 in a standing position so that a frame is fixed to the holder 10 with a space being secured between the frame described later and the substrate 11. In this example, two flat display panels 1 are respectively installed on both sides with a location of the plate fitted 12 as the center. It is desirable that the number of the plates 12 to be fitted is "m−1."

At the substrate 11, there are provided holes (openings) 14, 15, and 16 which are included to allow lead pins for individual electrodes (hereinafter referred to as individual electrode pins) 6 and lead pins for common electrodes (hereinafter referred to as common electrode pins) 7 installed in a standing position on the flat display panels 1 to be attached to surface 13 of the holder 10 and to allow a path for the exhaust glass tube 8. On the flat display panels 1 used in this embodiment, the individual electrode pins 6 are installed in a standing position in four rows at equal intervals. However, if two flat display panels 1 are fixed in a state of alignment, through holes 14, 15, and 16 will be provided at such positions that eight rows of the individual electrode pins 6 in total are arranged at equal intervals.

In this embodiment, a duplex tape 20 is used as a member for fixing the flat display panels 1 on the holder 10. The duplex tape 20 has a uniform thickness and is similar size to the substrate 11. However, as described above, in order to let the lead pins 6 and 7 and the exhaust glass tube 8 pass through the through holes 14, 15, and 16, openings must be similarly provided at positions of the duplex tape 20 corresponding to the through holes 14, 15, and 16 of the substrate 11. In order for the position of each opening to coincide with the corresponding opening when the duplex tape 20 is attached to the holder 10, a gap of the position is prevented by placing a mark on a surface of the substrate 11 or by providing an unevenness on an adhesive surface of the duplex tape 20 and the substrate 11.

After the duplex tape 20 is affixed to the holder 10, the flat display panels 1 are attached thereto. However, since the size of the holes 14 and 15 is set to be larger than the diameter of the lead pins 6 and 7, the position of the flat display panels is likely to deviate from the prescribed position in a pattern revolving around the central exhaust glass tube 8. The prescribed attachment position is the position where all of the flat display panels 1 to be fixed on the holder 10 aligned in parallel. Thus, in this embodiment, a deviation to the direction of revolution described above is prevented in the following manner.

Figure 4:
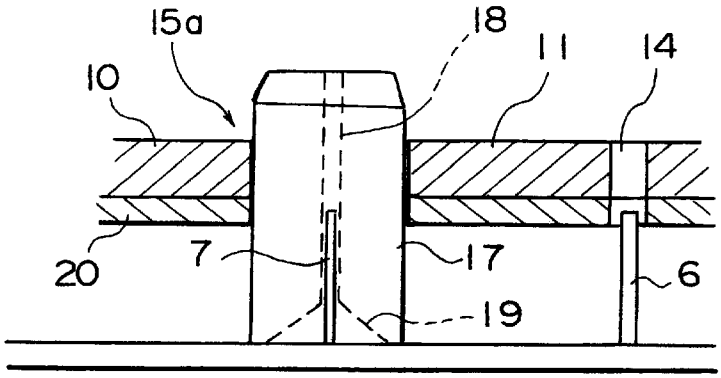
FIG. 4 shows an example of sticking jigs used when the flat display panels are installed in a holder according to the present invention.

FIG. 4 shows an example sticking jig used at the time of attaching the flat display panels 1 to the holder 10 in the process of attaching the flat display panels 1 to the holder 10. A cylindrical sticking jig 17 has an outside diameter equal to that of each through hole 15*a* of the common electrode pins 7. At the center of the sticking jig 17, a guide hole 18 having a diameter equal to that of each common electrode pin 7 is provided. Further, on a surface opposite to the flat display panels 1, a conic guiding section 19 is formed so as to guide the common electrode pins 7 to the guide hole 18. In this example, two common electrode pins 7 are used for attaching a single flat display panel 1 to a prescribed position, and two sticking jigs 17 corresponding to the two common electrode pins 7 are operated simultaneously.

Figure 5:
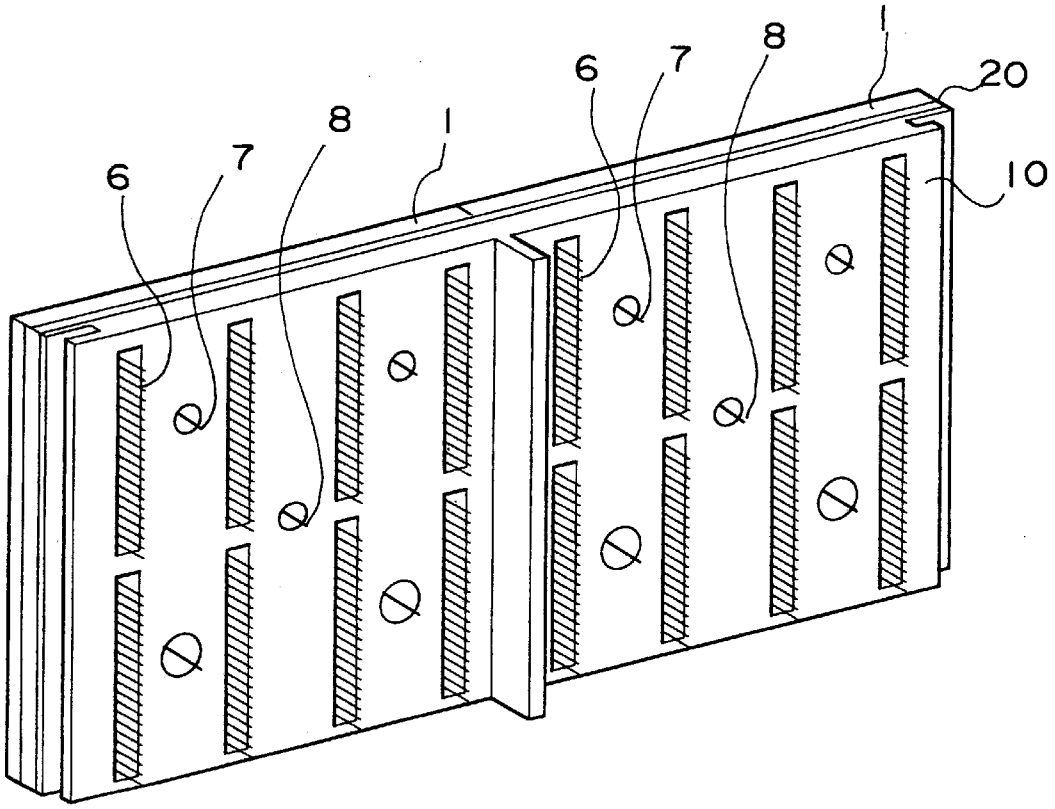
FIG. 5 shows overall constitution after two flat display panels are installed in a holder according to the present invention.

More specifically, when a flat display panel 1 is stuck on the holder 10, positioning is carried out by inserting the respective sticking jigs 17 into two through holes 15*a,* and then the common electrode pins 7 installed on the flat display panels 1 are inserted in the guide hole 18. Guiding the common electrode pins 7 to the guide hole 18 is easy because the insertion port is conical. If the flat display panel 1 is brought closer to the holder 10 after the common electrode pins 7 are inserted into the guide hole 18, the flat display panel itself will come into contact with the sticking jig 17 in due time. FIG. 4 shows a condition at this time. Further, by bringing the flat display panel 1 close to the holder 10, the flat display panel 1 comes into contact with the duplex tape 20 and attaches to it in due time while pushing up the sticking jig 17. Subsequently, the sticking jig 17 is removed. FIG. 5 shows overall constitution after the two flat display panels 1 are installed in the holder 10.

In the manner described above, deviation in the direction of revolution described above can be prevented. Further, by using a duplex tape 20 having a uniform thickness, it is possible to prevent the flat display panel 1 from leaning to a direction other than the direction of revolving around the central exhaust glass tube 8. In other words, the flat display panel 1 can be installed in the holder 10 with a surface of the flat display panel 1 being parallel with a surface of the substrate 11.

In this embodiment, in the manner mentioned above, the flat display panel 1 can be fixed on the holder 10. Since the flat display panel 1 is installed using two common electrode pins 7 as described above, deviation to the direction of revolution can be prevented. Although individual electrode pins 6 are densely arranged, there are no obstacles around the common electrode pins 7 and therefore these common electrode pins 7 are effectively utilized for positioning the holder 10.

Deviation in the direction of revolution can be prevented if prescribed points which are set in advance to eliminate deviation of the holder 10 and the flat display panel 1 to the direction of revolution coincide with each other. Thus, in this embodiment, for the purpose of illustrating the main feature, different diameters are used for to the through hole 15*a* and the through hole 15*b,* both of which are for the same common electrode pins 7. However, it does not matter even though these through holes have the same diameter. Further, because a conventional flat display panel 1 without any positioning mechanism is used, in this embodiment, the sticking jig 17 is used for positioning without modifying the flat display panel 1. However, if possible, a positioning mechanism may be provided to the flat display panel 1 so as to facilitate positioning.

Figure 6:
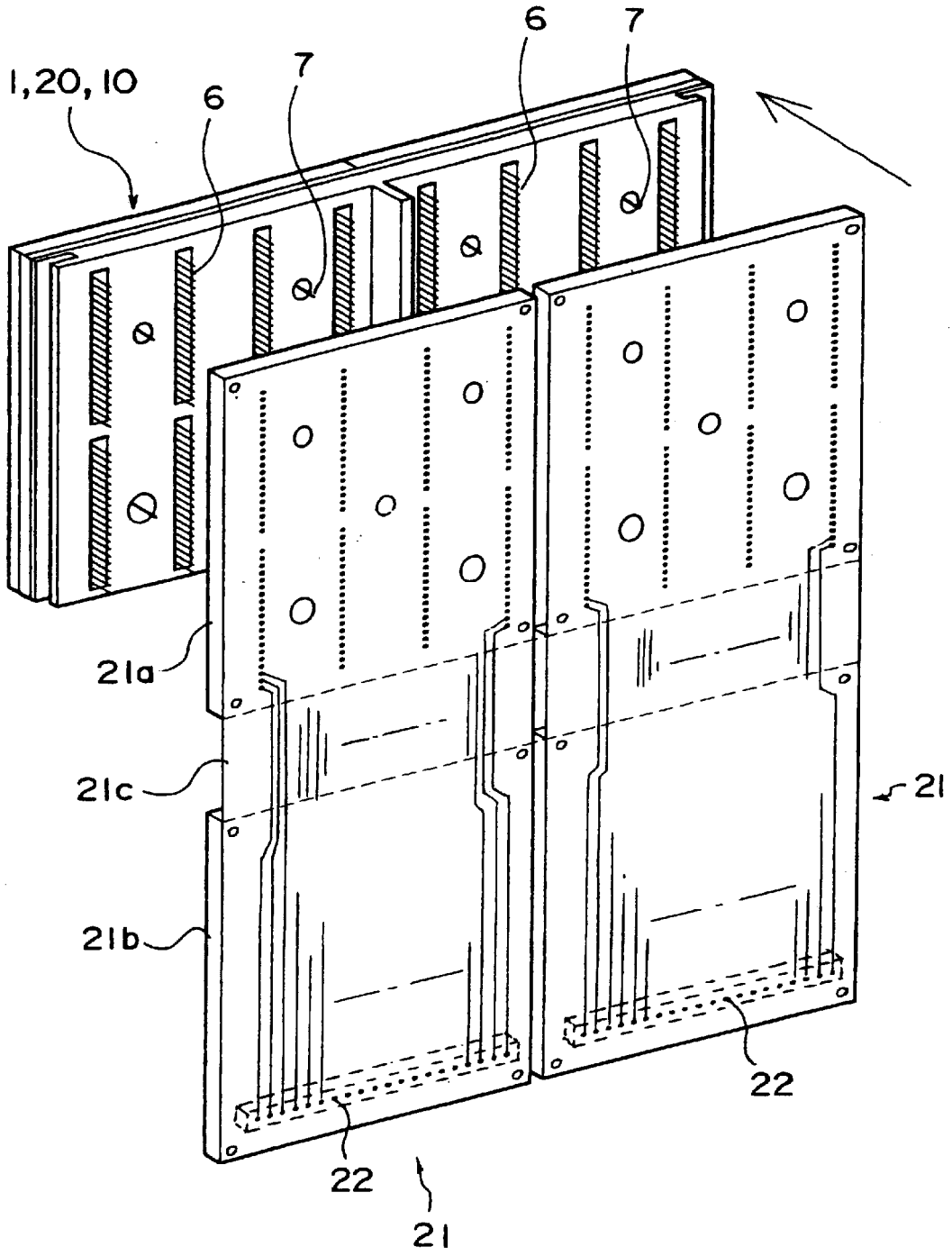
FIG. 6 is an explanatory view showing a process of fitting a flexible substrate on flat display panels from the back side of a holder according to the present invention.

Next, as shown in FIG. 6, a flexible substrate 21 is fitted to the flat display panel 1 from the back surface side of the holder 10 (Step 102). A method of fitting the flexible substrate 21 will be described, as will its constitution.

The flexible substrate 21 is a print substrate causing a fluorescent substance in the flat display panel 1 to emit light by supplying to the flat display panel 1 the voltage applied from external equipment. In this embodiment, the flexible substrate 21 is composed of a substrate section 21*a* which connects lead pins 6 and 7 of the flat display panel 1, a substrate section 21*b* for connecting the flat display panel 1 to the outside, and a bent section 21*c* which electrically connects each of the substrate sections 21*a* and 21*b*. Bent section 21*c* is bent at the time of submodule formation, as will be described in more detail later. Each of the substrate sections 21*a* and 21*b* is half the size of the holder 10, i.e., about the size of the flat display panel 1. Holes are provided at the positions of the substrate section 21*a* which correspond to lead pins 6 and 7. The lead pins 6 and 7 are installed in a standing position at the positions corresponding to the holes by insertion into the holes before four corners of and the substrate section 21*a* is screwed to the holder 10. The lead pins 6 and 7 which project from the holes are then soldered to the substrate section 21*a*. In such a manner, the flexible substrate 21 is fixed on the flat display panel 1.

Further, a connector 22 electrically connecting the flat display panel 1 to external equipment is fixed on the substrate section 21*b*. A large number of holes, including tapped holes, are provided at the positions of the substrate section 21*b* which correspond to the positions whether connector 22 is fixed, and a large number of pins fitted to the connector 22 are inserted into these respective holes. The connector 22 is screwed into places and the pins projecting from the holes are soldered. Thus, each of the lead pins 6 and 7 and each of the pins of the connector 22 are electrically connected. In other words, electrodes of the flat display panel 1 are extended to the connector 22 and collected at one place. In this embodiment, as two flat display panels 1 are attached to the holder 10, a number of flexible substrates 21 equivalent to the number of flat display panels 1 are installed.

In the manner described above, in this embodiment, m flat display panels 1 and the corresponding flexible substrates 21 are fixed on the holder 10 so as to form a unit.

Next, a frame is fitted to the holder 10 which constitutes the unit so as to form a submodule (Step 111). The frame is an instrument necessary for fixing the substrate section 21*b* of the unit and connecting other submodules. FIG. 7 shows the constitution of a frame used in this embodiment. In order to facilitate the understanding of the connection of a frame 30 and the holder 10, the holder 10 is shown by the broken lines in the center of FIG. 7. By the time the frame 30 is fitted, as described above, the flat display panel 1 and the flexible substrate 21 are already fixed on the holder 10. However, for the sake of simplicity, it is omitted from the drawing.

The frame 30 has a plate type body 31 with a width almost equal to that of the holder 10. Both ends of the frame 30 are bent by the height of the plate 12 and the tips are further bent so that a bent section 32 is formed. A connection member 33 for forming a module by the connection with another holder 10 is provided at an extended portion of one side which forms a width of the frame 30. The extended portion is extended in a direction of upper part of FIG. 7(*a*) [the right in FIG. 7(*c*)]. The bent section 32 is extended up to the connection member 33. A guide plate 34 which guides the connection member 33 of another frame 30 connected with the holder 10 is installed near the corner of the frame 30 which is situated on the lower part of FIG. 7(*a*) [the left in FIG. 7(*c*)] and also on one side forming a width of the frame 30. On one side of the body 31 and also on the lower part of FIG. 7(*a*) [the left in FIG. 7(*c*)], an assembly plate 35 is formed in a bent position to facilitate fitting of screws or pins which are used for fixing the frame 30 to a display or the like. Further, on a center line where the body 31 is in contact with the plate 12, tapped holes 36 for screwing in the plate 12 are provided. Tapped holes 37 for fixing the substrate section 21*b* are also provided. The frame 30 has a configuration of line symmetry around the center line described above its.

By fitting the bent section 32 of the frame 30 having the configuration described above in junction grooves 38 formed at both ends of the holder 10, the frame 30 is fixed on the holder 10. At this point, as shown in FIG. 7, the frame 30 is installed at such a position that the holder 10 is settled between a line, which links a tip of each guide plate 34, and an upper side 31*a* of the body 31.

Figure 8:
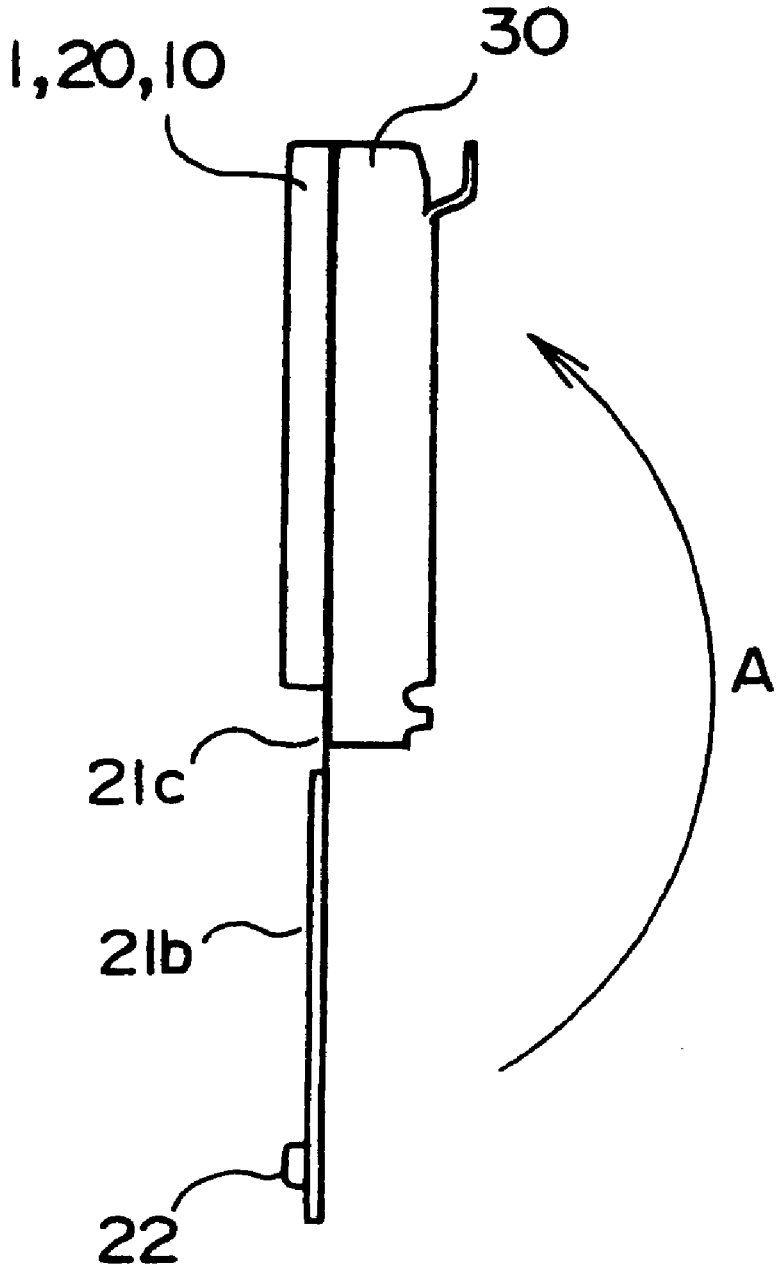
FIG. 8 shows the state immediately after a frame is fitted to a unit.

After the frame 30 is installed, the substrate section 21*b* of the flexible substrate 21 is in a state that it projects from a cage formed by the frame 30 and the holder 10 as shown in FIG. 8. In this embodiment, the substrate section 21*b* is lifted up in a direction indicated by an arrow A and fitted to a surface of the frame 30 (Step 112). At this time, as is clear from FIG. 7(*a*), there is a space between each connection member 33 of the frame 30 and therefore the bent section 21*c* of the flexible substrate 21 can be guided to a clearance 39 between the connection member 33 and the body 31. The substrate section 21*b* is then screwed on the frame 30 at its four corners.

Figure 9:
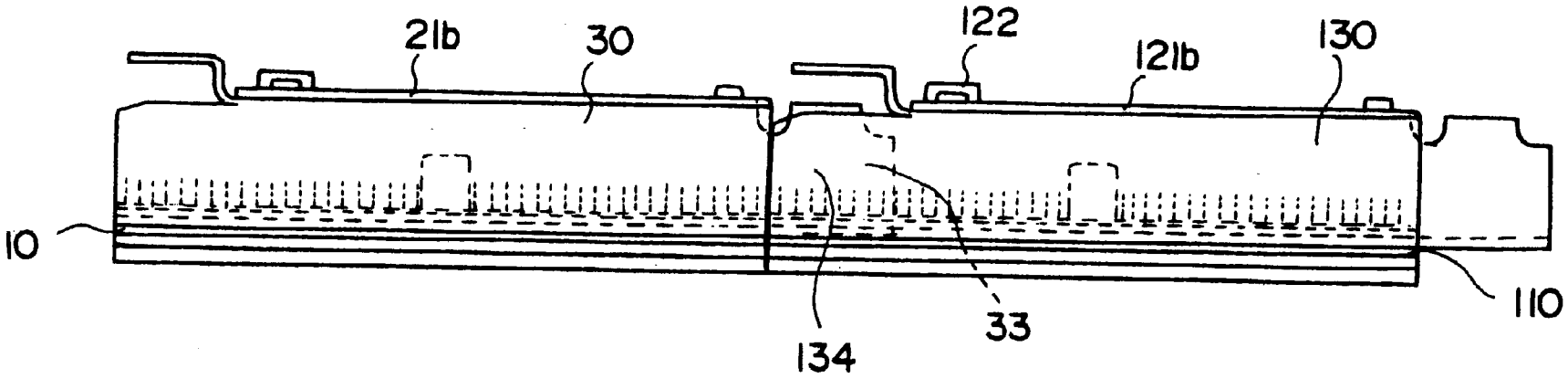
FIG. 9 is a side view of a module formed by connecting submodules.
Figure 10:
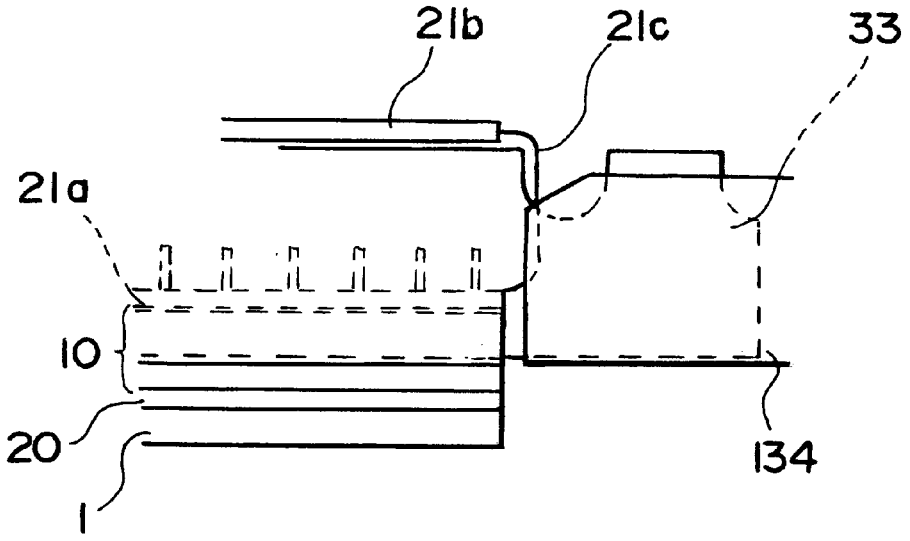
FIG. 10 is an enlarged side view showing a joint of the module shown in FIG. 9.
Figure 11:
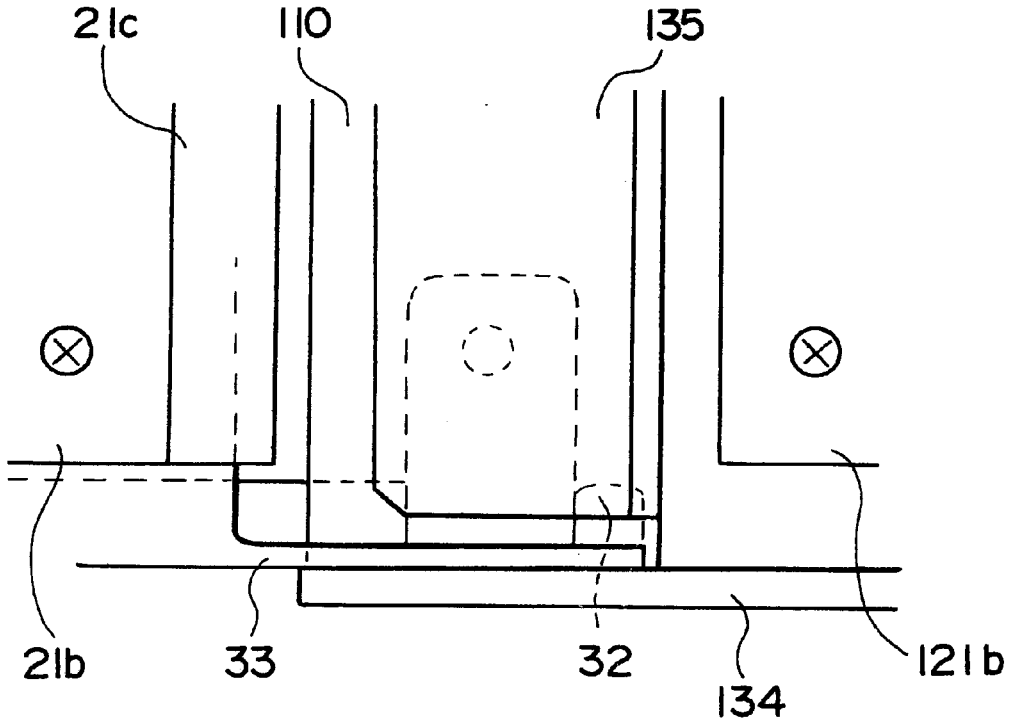
FIG. 11 is a plan view showing only the main part of the joint of the module shown in FIG. 9.

A submodule is formed by fitting the frame 30 on the holder 10 which constitutes a unit as described above, and then, by connecting submodules, a module is formed (Step 121). FIG. 9 is a side view showing a module formed by connecting two submodules. FIG. 10 is a an enlarged side view of the joint. FIG. 11 is a plan view, from the side of the frame 30, showing only the main part of the joint. In FIG. 9, FIG. 10 and FIG. 11, numeral 100 is added to a numeral attached to each member of another submodule which is connected by the connection member 33 of one submodule.

The side on which the connection member 33 of the two submodules formed is arranged is opposite the side on which a guide plate 134 is arranged. While the connection member 33 is inserted into another guide plate 134, the bent section 32 of the connection member 33 is inserted in junction grooves of another holder 110. In such a manner, two submodules are connected in a longitudinal direction of the screen so as to form a module.

To the module formed as described above, a total of four flat display panels, two panels for each of the two submodules (2×2), are fixed. The surface of a screen formed by these four flat display panels is a flat. By assembling the module longitudinally and latitudinally, a large display screen can easily be manufactured (Step 131). Even though a large display screen is manufactured, electrodes of each flat display panel are collected by the connector, whereby wiring is not intricate.

In this embodiment, a module is formed by a total of four flat display panels, and is set in a basic pattern. However, by increasing the number of flat display panels to be fixed on the holder, a module may be formed by a total of m×2 flat display panels, namely, each m pieces of flat display panels for two submodules. Further, by connecting n pieces of submodules, a module may be formed by a total of 2×n flat display panels, namely, each two flat display panels for n pieces of submodules. Further, "m×n" is also preferable.

Further, in the above description, by arranging modules longitudinally and latitudinally, a large display screen is manufactured. Thus, it is possible to more accurately and easily manufacture a large display screen as compared with a processing method of fixing flat display panels one by one. However, this method requires an adjustment of positioning between the modules in order to have a flat display screen. When a "x×y" display screen is manufactured, if m is equal to x and n is equal to y, it will be possible to surely manufacture a flat display screen.

What is claimed is:

1. A screen manufacturing method using flat display panels comprising:

a panel fixing step of aligning flat display panels which can independently be driven and perform display using a display section provided on a surface in response to an application of voltage to electrode pins installed on a back surface and fixing the flat display panels on a surface of a panel fixture; and a substrate fitting step of fitting a flexible substrate for electrically connecting external equipment which drives said flat display panels onto electrode pins of said flat display panels which penetrate through an opening provided at said panel fixture and project over a back surface side of said panel, wherein said flat display panels, said panel fixture, and said flexible substrate are unified during a process of producing a screen by lining up said plurality of flat display panels, so that a unit is formed.

2. The screen manufacturing method using flat display panels according to claim 1, wherein said panel fixing step comprises:

a positioning step of determining on which position of said panel fixture said plurality of flat display panels are stuck for lining up said flat display panels; and a sticking step of sticking said flat display panels to a position on a flat surface of said panel fixture which is determined at said positioning step.

3. The screen manufacturing method using flat display panels according to claim 2, wherein said positioning step is performed, at the time of sticking said flat display panels to said panel fixture, using a sticking jig having a guide hole in which an electrode pin of said flat display panel is to be inserted and being removably installed at the opening of said panel fixture.

4. The screen manufacturing method using flat display panels according to claim 1, said method comprising:

a frame fitting step of fitting to said unit a frame having a plate type body which surrounds a back surface side of said panel fixture; and a connector forming step of fixing, with said flexible substrate being bent, on a surface of the plate type body of said frame a joint with said external equipment electrically connected by said flexible substrate, said joint being sticking out from between said panel fixture and said frame, wherein a submodule is formed by fitting said frame to said unit.

5. The screen manufacturing method using flat display panels according to claim 4, wherein said frame fitting step comprises:

a step of fixing a bent section which is formed by bending both ends of the plate type body of said frame into junction grooves provided at both ends of said panel fixture.

6. The screen manufacturing method using flat display panels according to claim 4, said method comprising:

a connecting step of connecting a connection member fitted to said frame with another submodule, wherein a module is formed by connecting said submodules in a direction that said submodules are at right angles to a row of said flat display panels fixed on each of said panel fixtures.

7. The screen manufacturing method using flat display panels according to claim 6, wherein said connecting step comprising:

a step of attaching the bent section formed by bending both ends of the plate type body of said frame into junction grooves provided at both ends of said panel fixture which constitutes said another submodule to be connected.

8. The screen manufacturing method using display panels according to claim 6, wherein, by connecting a connection member of said frame which constitutes said module to another module, a display screen comprising said plurality of flat display panels arranged longitudinally and latitudinally is formed.

* * * * *

UNITED STATES PATENT AND TRADEMARK OFFICE

CERTIFICATE OF CORRECTION

PATENT NO. : 6,059,626
DATED : May 9, 2000
INVENTOR(S) : Kazuo Kimura et al.

It is certified that error appears in the above-identified patent and that said Letters Patent is hereby corrected as shown below:

Title page,
Item [57], ABSTRACT,
Line 3, delete the letter "m".

Column 1,
Line 15, "lages" should be -- Images --.

Column 4,
Line 22, "m-l" should be -- m-1 --.

Column 7,
Line 30, delete the letter "a".

Signed and Sealed this

Eleventh Day of March, 2003

JAMES E. ROGAN
*Director of the United States Patent and Trademark Office*